United States Patent [19]

Pariza

[11] 4,075,627

[45] Feb. 21, 1978

[54] ELECTRIC HORN

[75] Inventor: George R. Pariza, Schaumburg, Ill.

[73] Assignee: Pittway Corporation, Northbrook, Ill.

[21] Appl. No.: 765,049

[22] Filed: Feb. 2, 1977

[51] Int. Cl.[2] ..... G08B 3/10

[52] U.S. Cl. ..... 340/388; 340/392

[58] Field of Search ..... 340/388, 389, 390, 391, 340/392, 393, 394

[56] References Cited

U.S. PATENT DOCUMENTS

| | | | |
|---|---|---|---|
| 2,658,194 | 11/1953 | Kalin | 340/388 |
| 2,896,202 | 7/1959 | Bonanno | 340/388 |
| 3,179,932 | 4/1965 | Gregoroff | 340/388 |
| 3,408,645 | 10/1968 | Doggart | 340/388 |
| 3,631,480 | 12/1971 | Heap | 340/388 |

*Primary Examiner*—Harold I. Pitts
*Attorney, Agent, or Firm*—Gary, Juettner & Pyle

[57] ABSTRACT

A horn of improved, compact and efficient construction, formed of a minimum of components, is characterized by an electromagnetic coil within a closely confining magnetically permeable housing having an open end and relatively imperforate wall areas, a diaphragm positioned over and closing the open end, a striker operatively associated with the coil for repetitively striking the diaphragm to generate noise, and a cover having a sound directing port positioned over the diaphragm and forming therewith a sound chamber for directing generated noise toward and out of the port. The horn is thus formed of a small number of parts and is very economical.

The housing itself serves as the electromagnetic flux path for the coil, and therefore reduces the number of parts and the number of manufacturing steps required in the production of the horn. At the same time, the relatively imperforate wall areas of the housing, together with maintenance of parallelism between the components of the horn, maximizes the noise generated by the horn.

11 Claims, 3 Drawing Figures

ELECTRIC HORN

BACKGROUND OF THE INVENTION

The present invention relates to horns for generating an audible signal or alarm.

By way of example, fire detectors for sensing smoke or the products of combustion include a horn to sound an audible alarm so a fire will not go undetected for lack of immediate visual supervision, and so all personnel within hearing range of the alarm will be alerted to the danger. Such audible alarm is essential in environments such as homes, where immediate supervision is customarily lacking while the occupants are asleep.

It is not only desirable, but necessary, that the audible alarm generating horn be both efficient, to generate a very loud alarm, and reliable, to generate and continue generating an alarm every time and for as long as power is supplied to it. Therefore, horns of the general type should ideally be configured to maximize the sound level of the alarm generated thereby, and be designed to assure reliability.

In addition, the horns must be of small size because they are customarily confined within a small space, for example a relatively small household appliance such as a fire detector to be mounted on the wall or on the ceiling in a home; and they must also be of very economical construction to avoid pricing the appliance outside the economic reach of the general consumer.

OBJECTS OF THE INVENTION

It is the object of the present invention to provide an improved horn which is of small size, economical construction and great reliability, and which maximizes the intensity of the sound generated thereby.

In particular, it is an object of the invention to provide an improved horn embodying a minimum number of component parts, thereby to reduce the cost and increase the reliability of the horn and to facilitate the assembly thereof.

It is a further object of the invention to provide an improved construction for a horn, wherein the horn housing functions as the electromagnetic flux path for operating the horn.

SUMMARY OF THE INVENTION

In accordance with the present invention, an improved horn for generating an audible signal is characterized by a magnetically permeable housing having an open end and essentially imperforate walls, an electromagnetic coil closely confined within the housing, a diaphragm of relatively flexible material positioned on the housing over the open end and closing the housing, a striker of magnetically permeable material normally urged against the diaphragm and operatively associated with the coil within the housing for movement away from and strikingly against the diaphragm to generate noise, and a cover having a sound directing port therethrough secured to the housing over the diaphragm and forming therewith a sound chamber for directing generated noise through the port.

The assembly is thus comprised of a minimum number of components, wherein the housing itself comprises the magnetic flux path for the coil and the striker, thereby eliminating the need for a separate magnetically permeable bracket about the coil.

The housing is integrally formed and includes a lower cylindrical cup-shaped section of a first diameter and an upper cylindrical section of a second and larger diameter joined with the lower section by a radially extending annular shelf. The coil is secured in the lower section to position a pole face thereof adjacent and parallel to the annular shelf. The diaphragm is secured at its edge to the upper end of the upper section opposite from and parallel to the shelf. The diaphragm has a centrally displaced convex area extending into the upper section, and the striker is disposed between the convex area and the pole face of the coil. A spring secured between the striker and the shelf mounts the striker on the shelf and normally urges the striker against the displaced area of the diaphragm. The cover is secured at its edge to the upper end of said upper section over said diaphragm and includes an upwardly displaced planar portion lying parallel to the housing shelf and having the sound directing port formed therethrough.

As a consequence of the essentially imperforate housing walls and the parallelism of the housing, diaphragm and cover, the intensity of the noise generated by the horn is maximized or, stated another way, d.b. losses are minimized.

The above stated objects of the invention are thus attained with particular facility and economy. Other objects and advantages of the invention will become apparent from the following detailed description when taken in conjunction with the accompanying drawings.

DETAILED DESCRIPTION

Figure 1:
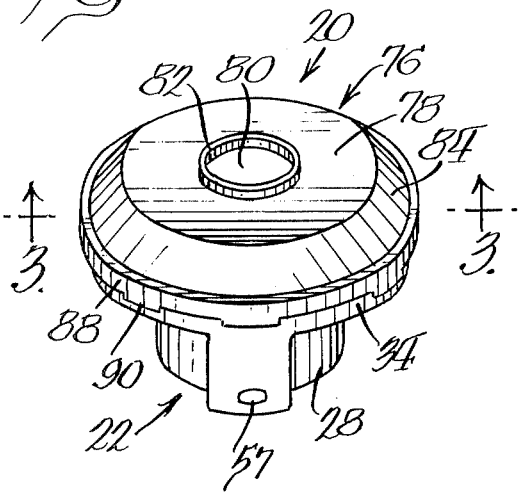
FIG. 1 is a perspective view of a preferred embodiment of the horn of the invention.
Figure 2:
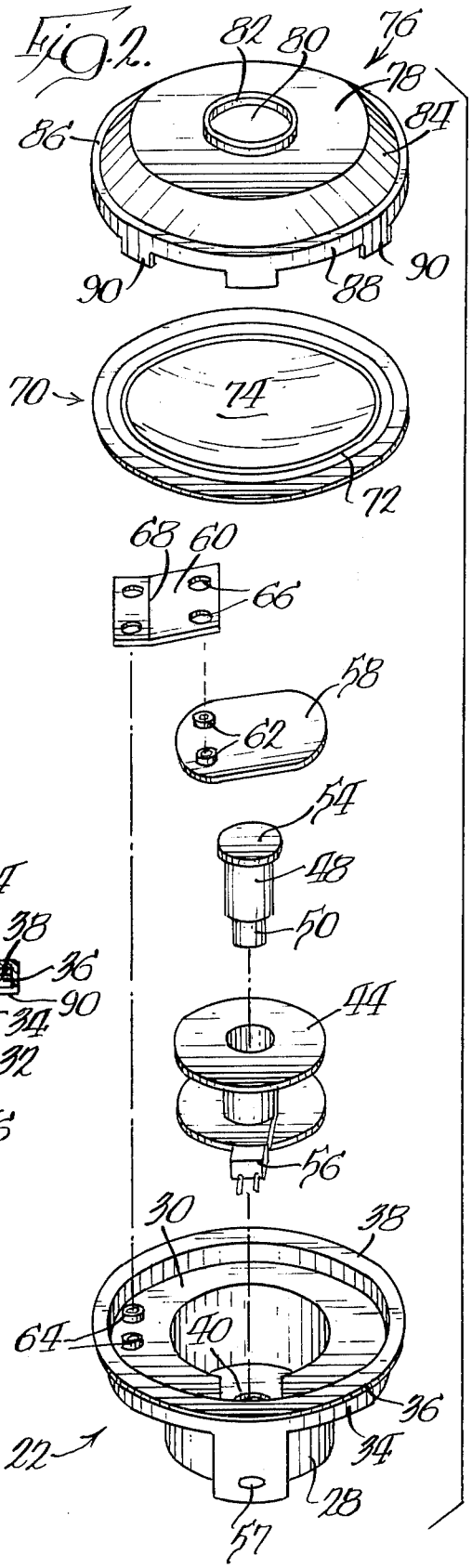
FIG. 2 is an exploded, perspective, assembly view showing all of the components of the horn and illustrating the paucity of components and the simplicity of assembly thereof.
Figure 3:
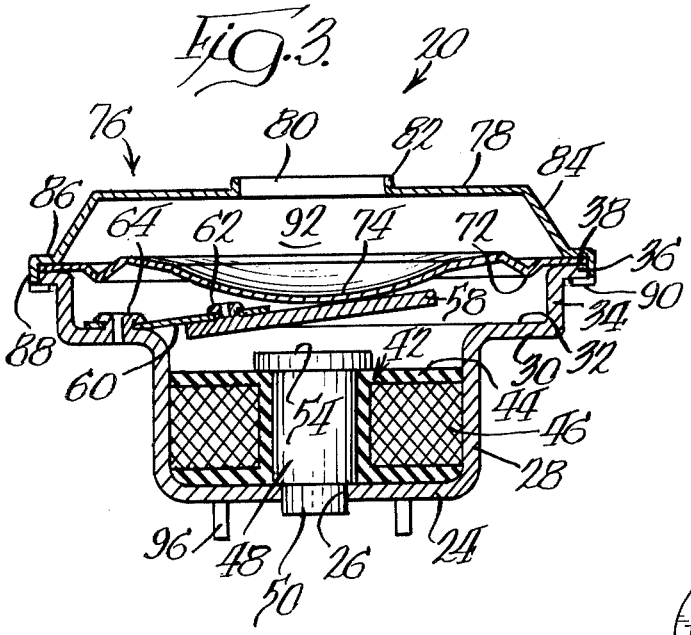
FIG. 3 is a vertical sectional view of the assembled horn, taken substantially along the lines 3—3 of FIG. 1.

The drawings illustrate an electrically operated horn 20 embodying the principles of the present invention. The horn may be used as an audible alarm wherever such alarms are required, but because of its compact and efficient structure is particularly suited for use as an audible alarm or sound generator within a fire detector (not shown). With particular reference to FIGS. 2 and 3, the horn includes an integrally formed, generally cup-shaped housing 22 having relatively imperforate walls. The housing is formed of magnetically permeable metal and has a generally circular planar base 24, a generally cylindrical lower section 28 of a first diameter extending perpendicularly upward from the circumference of the base 24, an annular flange or ledge 30 having an upper surface 32 defining a shelf extending radially outwardly from the upper end of the section 28 parallel to the base 24 and perpendicular to the axis of the section 28, a cylindrical upper section 34 of larger diameter than the section 28 extending perpendicularly upward from the outer circumference of the ledge 30, and a radially outward extending annular lip 36 having an upper surface 38. A slot or channel 40 is formed peripherally of and contiguous with the lower section 28 of the housing 22, coextensive with the upper section 34, by outwardly extending portions of the lower section.

An electromagnetic coil 42, including a bobbin 44 having a plurality of windings 46 of an insulated conductor and a core 48 of a magnetic material, is closely positioned in the lower section 28 of the housing to engage a lower surface of the bobbin with the base 24, and to extend a stud 50 formed integrally with the core 48 through the passage 26. The stud closes the passage 26 to maintain the imperforate nature of the housing and is staked or rolled over the exterior surface of the base to secure the coil within the housing. Preferably, the stud is formed with recessed, internal threads, which facilitate later mounting of the horn 20 to a substrate. In the orientation shown, the axis of the core 48 is perpendicular to the plane of the base 24, and a pole face 54 of the core extends upwardly. By staking the stud 50, the need for fasteners to secure the coil within the housing is eliminated, thereby minimizing the number of components in the horn and simplifying the design thereof. To connect the winding 46 with a source of voltage, a plug 56 extends from the lower portion of the bobbin 44 and is received within the slot 40 with terminals or conductors thereof extended through a passage 57 in the base of the slot.

A planar striker 58 of a magnetically permeable material is supported above and in a spaced relationship from the pole face 54 by a leaf spring 60, also of magnetically permeable material, extended between the striker and the ledge 30. While the spring 60 may be secured to the striker and the ledge with conventional fasteners, such as threaded screws, in a preferred manufacturing method which further minimizes the number of components, the spring is spot welded to the striker and ledge, or is secured thereto as by nubs 62 extended through and staked over passages 66 in the spring. The spring is curved along a gentle radius as at 68 to orient the striker at a slight angle above the pole face 54, and in the operation of the horn the striker is alternately moved toward the pole face 54 by the coil 42 and then away from the pole face by the spring 60.

At this point, it should be appreciated that the magnetically permeable housing, spring and striker are interconnected to cooperate in defining or establishing an efficient media for magnetic flux from the lower pole of the coil core to the striker, to maximize the magnetic attraction between the striker and the upper pole face 54. This efficient design compares with conventially designed horns where a separate magnetically permeable bracket, with attendant fasteners, would be extended between the lower pole face and the spring to accomplish the same function. Consequently, by utilizing the housing itself as a low reluctance and high permeability media, the number of components is yet further minimized, and the structural reliability of the horn is increased.

A circular sound disc or diaphragm 70 of a relatively flexible material, preferably of metal and having a diameter approximately equal to the outer diameter of the lip 36, is circumferentially supported on the surface 38 of the lip. The diaphragm is formed with a downwardly extending (as shown in the drawings) annular ridge 72 spaced from the circumference thereof, and a downwardly displaced concave (as viewed from above) central portion 74 which normally engages the striker 58. To this end, it should be noted that the leaf spring 60 in maintaining the striker above the pole face 54 normally urges the striker against the displaced central portion 74.

The diaphragm is held over the housing 22 and against the surface 38 of the annular lip 36 by an integrally formed substantially conical frustrum-shaped cover 76. The cover includes a circular, planar top portion 78 having a circular sound exit port 80 formed in the center thereof with an outwardly extending sound directing lip 82 therearound. A side wall 84 extends downwardly and outwardly from the circumference of the top portion to an annular lip 86, which extends parallel to the top portion and has an outer diameter substantially equal to the outer diameter of the lip 36. A flange 88 extends downwardly from the lip 86 in a direction essentially perpendicular thereto, and terminates in a plurality of spaced, bendable tabs, tines or fingers 90. The cover is positioned over the diaphragm with a lower surface of the lip 86 resting on the diaphragm around and adjacent to the circumference thereof and with the flange 88 extending downwardly past the outer periphery of the annular lip 36. The tabs 90 are then bent inward and under the lip to securely fasten the cover to the housing with the diaphragm captured therebetween. In the alternative, the cover may be formed without the tabs, and the flange 88 rolled under the lip 36 to fasten the cover to the housing. The cover thus defines with the diaphragm a substantially conical frustrum-shaped sound directing chamber 92 for efficiently directing generated noise through the port 80.

To operate the horn, a source of voltage (not shown), which may either be an a.c. voltage or a periodic d.c. voltage, is connected across the windings 46 of the electromagnetic coil 42. This may be accomplished exterior of the horn via terminals of the plug 56 extended through the passage 57 or, in the event the terminals are interior of the horn, via conductors extended through the passage 57. With the voltage across the coil windings, a field of magnetic flux is repetitively and intermittently generated through the magnetically permeable media of the coil core 48, the housing 22, the spring 60 and the striker 58, to draw the striker away from the diaphragm 70 and toward the pole face 54 against the urging of the spring, and to then release the striker for movement toward and impact against the displaced portion 74 of the diaphragm under the urging of the spring. With each impact of the striker against the diaphragm, a sharp report or sound is generated for exit externally of the horn both directly through the sound exit port 80 and through the vibration of horn surfaces.

In the use of the horn with a fire detector, for example, the horn conveniently is mounted on a substrate for supporting other components of the detector, by extending the internally threaded stud 50 through a passage in the substrate and attaching a suitable fastener thereto. In the alternative, or in the event the stud is not threaded, the horn may be mounted by a pair of tabs 96, formed integrally with the base 24, extended through passages in the substrate. The tabs orient the horn on the substrate, and may be folded over or soldered to the substrate to secure the horn thereto. When the tabs are used, the base of the coil preferably is provided with a molded gasket (not shown) to seal openings in the base left by the tabs to maintain the imperforate nature of the housing.

In view of the foregoing, it is appreciated that the horn is of compact, efficient structure, and utilizes minimum numbers of components capable of ready assembly. By the expedients of staking or spot welding, the need for conventional fasteners has been eliminated. More importantly, by using the housing itself as a permeable path of magnetic flux, the bracket customarily extended between the base of the coil and the spring-striker assembly is not required. Further, the design of the horn, e.g. parallelism between sound directing surfaces and essentially imperforate wall areas, maximizes the intensity of the noise generated by the horn.

While one embodiment of the invention has been described in detail, it is to be understood that various embodiments and other modifications thereof may be devised by one skilled in the art without departing from the spirit and scope of the invention, as defined by the appended claims.

What is claimed is:

1. An improved horn for generating an audible signal, comprising a housing formed of magnetically permeable material having walls the margins of which define an opening; an electromagnetic coil closely confined within said housing; a diaphragm of relatively flexible material positioned on said housing over said opening and closing said housing; and a striker member of magnetically permeable material mounted in said housing between said diaphragm and said coil and operatively associated with said coil for movement away from and strikingly against said diaphragm to generate noise, said housing itself constituting the magnetic flux path for said coil and striker.

2. An improved horn as in claim 1, said coil having a pair of magnetic poles, one of said poles being positioned closely adjacent a wall area of said housing, said striker being connected with said housing through a magnetically permeable path and being operatively associated with the other of said poles, whereby magnetic flux at said one pole is linked with said striker through said housing and said magnetically permeable path.

3. An improved horn as in claim 2, a spring of magnetically permeable material connecting said striker to said housing and providing said magnetically permeable path therebetween, said spring normally urging said striker against said diaphragm.

4. An improved horn as in claim 1, a cover, said housing having an outwardly extending lip about said opening, said diaphragm and cover resting on said lip, said housing and cover having interengaging portions securing said cover to said housing with said diaphragm therebetween.

5. An improved horn as in claim 4, said cover having conical-frustrum shaped walls, said cover having a port therethrough for the passage of noise generated by said horn.

6. In an improved horn as in claim 1, said diaphragm having an inner area thereof displaced into a convex surface extending into said housing, including means for normally urging said striker against said convex surface, said striker being movable against said urging means away from said convex surface by said coil and then being releasable by said coil for movement by said urging means strikingly against said convex area to generate noise.

7. An improved horn for generating an audible signal, a cup-shaped housing having walls of magnetically permeable material, said wall defining a cylindrical lower section closed at one end and having a first outwardly extending annular lip at an opposite end thereof, and a cylindrical upper section extending at one end thereof from the circumference of said first lip and having a second outwardly extending annular lip at an opposite end thereof; an electromagnetic coil closely positioned within said lower section, said coil having a pair of poles, one of said poles being positioned closely adjacent said closed end of said lower section; a diaphragm of relatively flexible material positioned on said second lip; and a striker member of magnetically permeable material resiliently mounted in said housing in operative association with the other pole of said coil for movement away from and strikingly against said diaphragm to generate noise, said housing itself constituting the magnetic flux path between said one coil pole and said striker.

8. An improved horn as in claim 7, said striker being resiliently mounted in said housing by a magnetically permeable spring connected between said striker and said first lip.

9. An improved horn as in claim 8, said diaphragm having a displaced convex area, said spring normally urging said striker against said convex area.

10. An improved horn as in claim 7, a cover resting on said diaphragm around said second lip, said housing and cover having interengaging portions securing said cover to said housing with said diaphragm therebetween.

11. An improved horn as in claim 10, said cover having a circular top wall having a sound exit port formed centrally therethrough, conical-frustrum shaped side walls extending at one end thereof from the circumference of said top wall, and a third annular lip extending outward from an opposite end of said side walls, said third annular lip resting on said diaphragm above said second annular lip.

* * * * *